US005255392A

United States Patent [19]

Stanislaw

[11] Patent Number: 5,255,392

[45] Date of Patent: Oct. 26, 1993

[54] CONCEALED POCKET

[75] Inventor: Thelma E. Stanislaw, St. Louis, Mo.

[73] Assignee: Vacco Corporation, St. Louis, Mo.

[21] Appl. No.: 712,923

[22] Filed: Jun. 7, 1991

[51] Int. Cl.[5] ..... A41D 27/20

[52] U.S. Cl. ..... 2/247; 2/67; 2/79; 2/250; 2/252; 2/400; 2/403; 450/150

[58] Field of Search ..... 2/67, 79, 227, 247, 2/248, 249, 251, 252, 254, 400, 401, 403, 402, 406; 450/89, 150

[56] References Cited

U.S. PATENT DOCUMENTS

| | | | |
|---|---|---|---|
| Re. 20,567 | 12/1937 | Bachelis | 2/67 |
| 1,256,787 | 2/1918 | Grant | 2/252 |
| 1,273,419 | 7/1918 | Stewart | 2/249 |
| 1,448,940 | 3/1923 | Pohlkolte | 2/248 |
| 1,685,243 | 9/1928 | Rich | 2/248 |
| 1,933,744 | 11/1933 | Lorenz | 2/67 |
| 1,944,482 | 1/1934 | Wunship | 2/67 |
| 2,129,196 | 9/1938 | Boshnack et al. | 2/254 |
| 2,489,148 | 11/1949 | Ludwig | 2/247 |
| 2,544,840 | 3/1951 | Kowatsch | 2/67 |
| 2,544,840 | 3/1951 | Kowatsch | 2/67 |
| 2,637,040 | 5/1953 | Kay | 2/247 |
| 2,709,815 | 6/1955 | Nelson | 2/247 |
| 3,137,862 | 6/1964 | Mizerak | 2/224 |
| 3,440,666 | 4/1969 | Fitzpatrick | 2/251 |
| 3,459,181 | 8/1969 | Mann | 2/403 X |
| 4,139,914 | 2/1979 | Tarr | 2/247 |
| 4,145,762 | 3/1979 | Wallach | 2/67 |
| 4,235,356 | 11/1980 | Atchisson | 2/247 X |
| 4,464,798 | 8/1984 | Livingstone | 2/247 |
| 4,545,079 | 10/1985 | Bakken | 2/247 X |
| 4,656,670 | 4/1987 | Schluter | 2/92 |
| 4,677,697 | 7/1987 | Hayes | 2/159 |
| 4,791,681 | 12/1988 | Dean | 2/247 X |
| 5,067,178 | 11/1991 | Katchka | 2/67 X |

FOREIGN PATENT DOCUMENTS

| | | | |
|---|---|---|---|
| 2607613 | 2/1976 | Fed. Rep. of Germany | 2/67 |
| 347496 | 7/1960 | Switzerland | 2/247 |

*Primary Examiner*—Werner H. Schroeder
*Assistant Examiner*—Jeanette E. Chapman
*Attorney, Agent, or Firm*—Heller & Kepler

[57] ABSTRACT

A concealed pocket assembly, and more particularly, a concealed pocket assembly which can be incorporated into swim wear, beach wear, active wear, exercise wear and related articles. The concealed pocket assembly is generally provided for incorporation into clothing. The concealed pocket assembly includes a pocket member attached to a fabric portion adjacent an edge of the opening of the pocket and in association with a lining portion of the garment.

18 Claims, 5 Drawing Sheets

CONCEALED POCKET

BACKGROUND OF THE INVENTION

The present invention relates in general to concealing personal items in an article of clothing and pertains, more particularly, to a concealed pocket for concealing personal articles when wearing clothing that does not normally include pockets and provides a concealed, water repellant or waterproof pocket, particularly for incorporation into swim wear and beach wear. The concealed pocket of this invention is an improvement over the conventional concealed pockets.

There are several different designs and types of pockets which are incorporated into clothing of one sort or another. Some of the pockets are not concealed and some are designed to be concealed. The concealed type of pocket is typically designed to hide or conceal valuable personal property, such as money, keys and credit cards.

With the conventional concealed pocket swimmers or bathers go to the beach or water front and generally encounter the problem of securing various personal items. A drawback associated with this problem is what to do with car keys, hotel or motel room keys, cabin keys, money and credit cards. It would not be unexpected to discover that reports of theft of personal property on a beach or while on board a cruise ship results in an unhealthy atmosphere.

Another drawback associated with the possibility of theft of keys, money or credit cards unattended on a beach or on board a cruise ship is the danger associated with the temptation to remove these personal items even if they are located in a bag or in the pockets of outer wear left on the beach or pool-side. Existing attempts to solve this problem, including both exposed and concealed pocket arrangements, have not been found to be satisfactory by the consumer and difficult to incorporate into current fashions by designers.

Conventional pocket arrangements have a number of undesirable features, such as not being concealed, creating a visible pocket line, substantially non-functional for the purpose of holding and concealing small personal property, such as keys, money or credit ds, and not being water proof or repellant.

SUMMARY OF THE INVENTION

Accordingly, it is an object of the present invention to provide an improved concealed pocket that is adapted for incorporation into clothing and other articles, such as swim wear, beach wear, active wear and exercise wear. With the concealed pocket of this invention it is expected that items of personal property, such as keys, money and credit cards can be carried in the concealed pocket without the items becoming water soaked or conspicuous.

Another object of the present invention is to provide an improved concealed pocket that is assembled to provide a pocket which can be incorporated into an article of clothing without creating a substantially visible line in the fabric of the article of clothing, thereby revealing the pocket and its location.

A further object of the present invention is to provide a concealed pocket that is adapted for incorporation into a garment or a patch of material used to construct a garment.

Still another object of the present invention is to provide a removable pouch that may be readily removed and replaced into an opening defined by the concealed pocket assembly. The pouch of this invention is preferably a substantially sealed, water repellant or waterproof article.

Still a further object of the present invention is to provide a concealed pocket that is substantially waterproof for holding items of personal property and further keeping the contents dry or substantially dry even when the clothing is wet.

To accomplish the foregoing and other objects of this invention there is provided a concealed pocket assembly for incorporation into a garment or into a portion or patch of fabric material used in the construction of garments, such as beach wear, and more particularly swimming suits for concealing the location of the pocket behind the fabric of the garment, that is, generally intermediate the garment and the wearer.

The concealed pocket of this invention comprises a concealed pocket assembly for attaching a pocket to a fabric portion with a pocket means for receiving an article and the pocket means including closing means for substantially sealing the pocket means. In constructing or assembling the concealed pocket there is an outer panel means attached to the pocket means and an inner panel means also attached to the pocket means. Both the inner and the outer panel means form an envelope for generally receiving the pocket means.

Further provided is a marginal portion generally located or associated with one or the other or both of the inner and outer panel means. The marginal portion adjacent the closing means provides the wearer with a purchase or grip for opening the pocket means when closed without adding unnecessary bulk to the construction or assembly.

The assembly construction is completed by the application of an attachment means for attaching the envelope to a fabric portion with the outer panel means intermediate the fabric portion and the pocket means. The attachment means is spaced apart from an edge of the fabric portion and is generally coextensive with the marginal portion.

The concealed pocket assembly of the present invention is preferably adapted for attaching a pocket to a fabric portion and is thus used in combination with the pocket member and a plurality of panel members attached to the pocket member.

In the disclosed embodiment described herein there are provided a plurality of panel members defining an opening for providing access to the interior of the pocket member. This is accomplished by associating the panel members to form a pouch or an envelope. One attaching means attaches the panel members to the pocket member and another attaching means attaches the panel assembly to a fabric portion.

Also, in the invention and illustrated for the preferred embodiments, the attachment means attaches the pocket assembly to the fabric portion in a manner so as to substantially conceal the pocket assembly.

The method of constructing a concealed pocket assembly comprises the steps of constructing a pocket means for receiving an article by attaching an outer panel means to the pocket means and attaching an inner panel means to the pocket means, thereby constructing an envelope for the pocket means with the outer panel means and the inner panel means.

A marginal portion of either one or the other or both of the inner and outer panel means is extended past the pocket means. The envelope is attached to a fabric portion with the outer panel means intermediate the fabric portion and the pocket means, and the attachment means spaced away from an edge of the fabric portion and coextensive with the marginal portion.

Typically, the pouch or a pocket means consists of inside and outside dye cut pieces, the pieces generally being rectangular and sized to fit within the pocket or envelope. The pieces are typically joined by sewing or by ultrasonic welding along the outer edges of the joined pieces. The method of joining the pieces would be dependent upon the type of material being used. The pieces are joined along three sides leaving the fourth side open. This opening is the opening to the pouch or pocket means. A marginal portion provides an attachment flap.

These and other objects and features of the present invention will be better understood and appreciated from the following detailed description of various embodiments thereof, selected for purposes of illustration and shown in the accompanying drawings.

DETAILED DESCRIPTION

Figure 1:
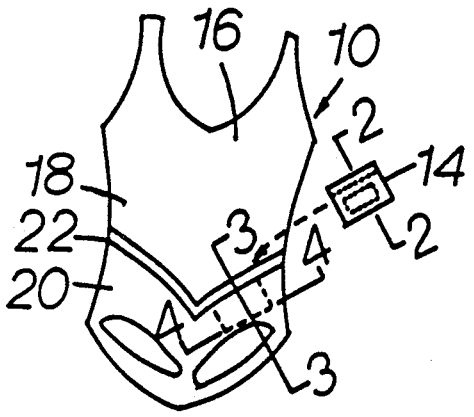
FIG. 1 depicts a concealed pocket with a removable assembly constructed in accordance with the present invention.
Figure 2:
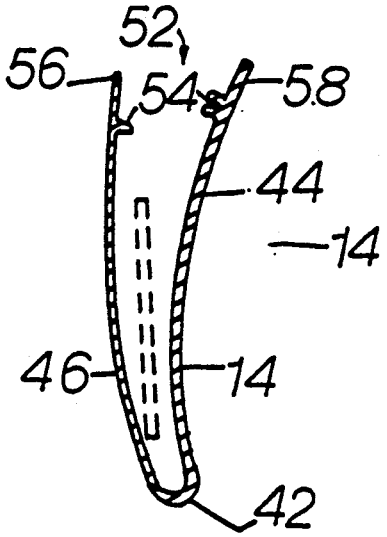
FIG. 2 is a cross-sectional view taken along line 2—2 in FIG. 1.
Figure 3:
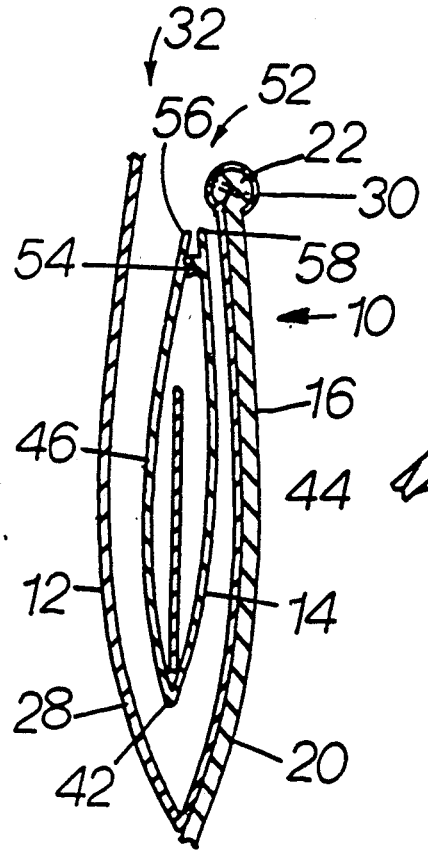
FIG. 3 is a cross-sectional view taken along line 3—3 in FIG. 1.
Figure 4:
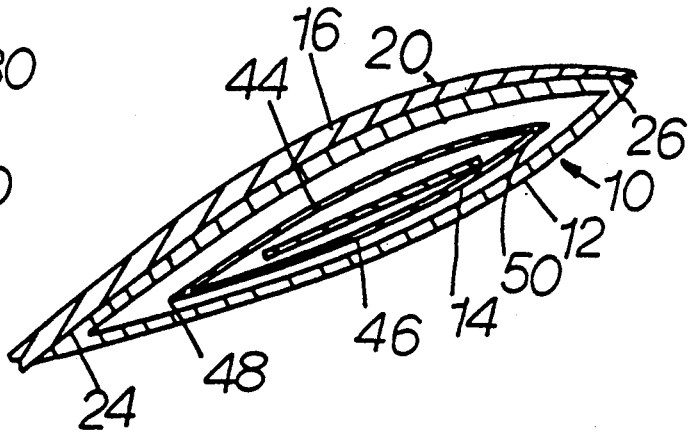
FIG. 4 is a cross-sectional view taken along line 4—4 in FIG. 1.
Figure 5:
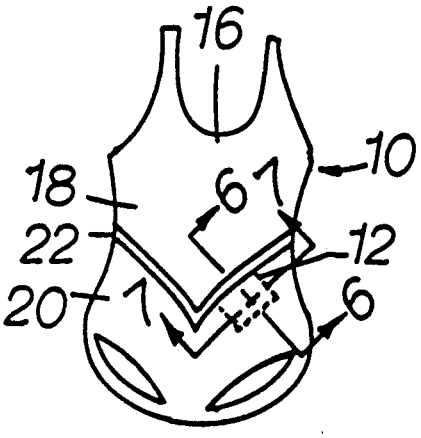
FIG. 5 depicts a concealed pocket with a permanent assembly constructed in accordance with another embodiment of the present invention.
Figure 6:
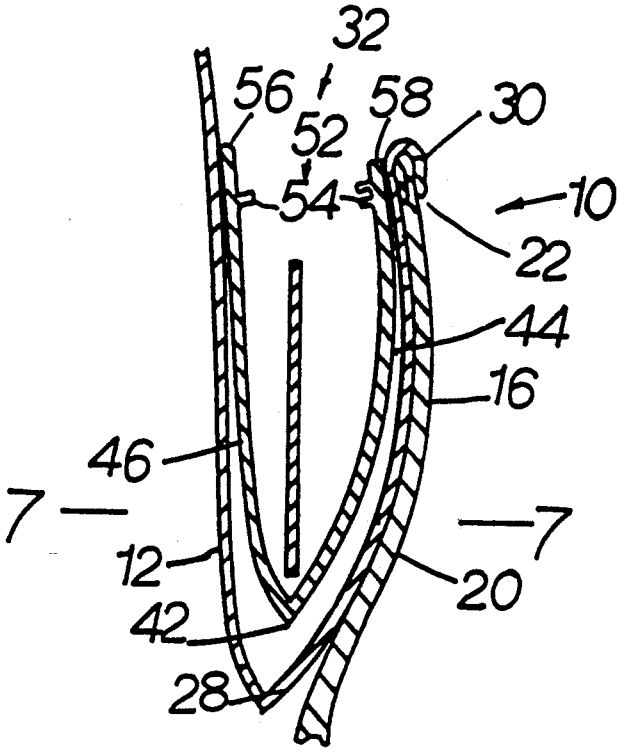
FIG. 6 is a cross-sectional view taken along line 6—6 in FIG. 5.
Figure 7:
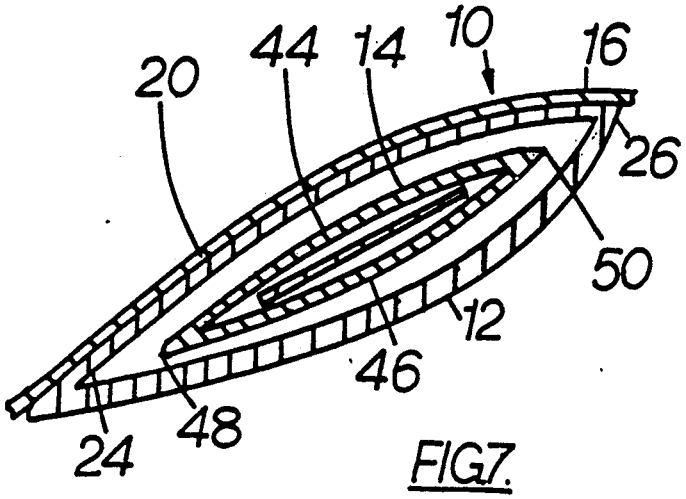
FIG. 7 is a cross-sectional view taken along line 7—7 in FIG. 5.

Referring now to the drawings there are shown preferred embodiments for the concealed pocket assembly of this invention. The concealed pocket assembly is described in connection with a plurality of swim wear applications to provide a concealed or hidden pocket in an otherwise conventionally revealing article of clothing.

The concealed pocket of the present invention is particularly adapted for providing a concealed pocket or pouch in association with a fabric portion of the garment or clothing article and is characterized by an improved assembly that can be added to the conventional clothing article without revealing its location to the casual observer.

The drawings show the concealed pocket assembly 10 in conjunction with various articles of swim wear or fabric portions used to construct the swim wear, beach wear, active wear, exercise wear and related articles. The concealed pocket 10 when incorporated into clothing or other types of articles is hidden for all practical purposes.

The concealed pocket assembly 10 includes an envelope assembly or pocket 12 formed by panel means or members which are assembled to form the envelope for a pocket means 14. This packet means 14 is depicted in two embodiments, one which can be permanently attached to the envelope 12, or the embodiment identified as pouch 14 which can be made to be easily removed from and inserted into pocket 12 as desired by the wearer.

The concealed pocket assembly 10 is arranged to be incorporated into otherwise conventional clothing articles or be manufactured as a patch that is one of a plurality of fabric patches used to construct the article of clothing.

The concealed pocket assembly 10 is typically incorporated into an article of clothing along a seam, an edge of a waist band, or at a location where there is a change in colors or patterns, or at any other location where there is a seam on an edge of the fabric portion or clothing article. The opening of the concealed pocket, 10 preferably lies along the construction seam of the clothing article. Thus, the opening remains substantially concealed by the seam.

The pocket or envelope 12 is preferably constructed from a material such as that used in the lining of the clothing article. It is understood that typical lining material is thin, light weight, and often stretchable.

The envelope or pocket 12 is formed by attaching opposing portions or panels together, although it would be possible to construct the envelope by folding a single panel back over itself and sewing or attaching the adjacent sides of the folded material together. The opening formed by the panels defines an opening 32 of the pocket or envelope 12. The lower seam or fold in the fabric panel constitutes the bottom of the pocket or envelope 12.

As illustrated in the drawing figures, the pocket or envelope 12 can be attached to or incorporated into an article of clothing at one of several locations and still provide the desired concealment of the existence of any pocket at all in the garment.

It will be understood that the concealed pocket assembly of the present invention can be incorporated into a variety of clothing articles and along a seam or construction or assembly junction without departing from the spirit and scope of the present invention. It will be further understood that the means by which the concealed pocket assembly 10 is assembled and incorporated into a clothing article depends on the particular type of clothing article and the location of the desired location of the concealed pocket.

In one embodiment, the concealed pocket 10 is incorporated into a woman's one piece swimsuit 16, as illustrated in FIGS. 1–7. The swimsuit 16, as illustrated for an example, contains an upper portion 18 and a lower portion 20. A conventional decorative seam 22, generally along the waist, separates the upper portion 18 and lower portion 20.

The seam 22 is formed by sewing together the folded bottom edge of the material of the upper portion 18 to the folded upper edge of the lower portion 20. This creates a joint in which to incorporate the concealed pocket assembly 10 of this invention.

A section 28 of the material of the upper portion 18, at a width of the pocket 12 is allowed to extend below the rest of the lower edge of the upper portion 18. The length of the extension is depicted as generally twice the depth of the pocket or envelope 12 plus the width of the seam 22, although other relative dimensions may be used to suit the application.

The section 28 of the material which extends below the seam 22, is either sewn together at the bottom and sides or may be folded over itself to form the pocket or envelope 12. The adjacent edges of the folded material are sewn or joined to form the sides 24 and 26 of pocket or envelope 12.

The outer edge 30 of the section 28 is folded over the seam 22 along with the upper edge of the lower portion 20. The envelope opening 32 is not sewn closed when the folded lower edge of upper portion 18 is sewn to the upper edge of the lower portion 20. The outer edge 30 of section 28 which is folded over the seam 22 is sewn along with the lower edge of the upper portion 18 to the upper edge of lower portion 20. The pocket or envelope opening 32 is thus completely incorporated into and concealed by the seam 22.

The pocket 14 is typically constructed from vinyl or other waterproof or water repellant or resistant material. The pocket 14, as illustrated in the accompanying figures, is constructed from a single piece of vinyl or other waterproof material in one preferred embodiment. The material 40, if folded, is folded in half, thereby, creating a fold 42, front 44 and back 46.

The adjacent edges of the folded material 40 are joined and sealed, creating sides 48 and 50. The side opposite the fold 42 is not sealed, thereby, creating the opening 52 to the pocket 14.

A closure device 54, if utilized, is incorporated on the inside of pocket 14 at a location slightly below the edges of the front piece 44 and back piece 46, which constitutes the opening 52 of pocket 14.

The area between the closure device 54, and the edges of the opening 52 defines a marginal portion provided by one or the other or both of the inner and outer panel means 44 and 46, whether sewn or folded and is located proximate or adjacent the pocket or envelope opening. The marginal portions or means provide a wearer some purchase for opening the pocket or envelope means when closed. The marginal portions are also identified and referred to hereinafter as sewing flaps 56 and 58.

A closure means is provided if desired and in a preferred embodiment is a generally water repellant interlocking lip arrangement.

As depicted in the drawing figures, the closure device 54 can be an ordinary zipper in a non-waterproof embodiment, a slide closure and sealer, or a conventional ZIPLOC® style sealer as illustrated in the accompanying drawing figures. The type of closure device 54 and material 40 will determine how the closure device 54 is attached to the pouch or pocket 14. The "ZIPLOCK" closure, as illustrated, may be formed as part of the vinyl from which the pouch or pocket 14 is constructed.

The closure device may be attached by welding (suitable for a vinyl material) or sewn, depending on the particular type of material being used and whether the pouch or pocket 14 is to be waterproof. The drawings depict the closure member as integral with the pocket for purposes of clarity. An embodiment could be manufactured with the closure integral with the material, although for purposes of economy, the closure would typically be purchased separately and attached to the pocket prior to construction of the invention.

In one of the preferred embodiments, the pocket 14 is permanently installed in the envelope 12. The pouch or pocket 14 is attached to the inside of envelope 12 by sewing flaps 56 and 58. The sewing flaps 56 and 58 are attached, typically by sewing, to the material that makes up the envelope 12 at a location slightly below the seam 22 and opening 32 to concealed pocket 10. The location below the seam 22 is such that the pouch or pocket 14 does not extend above the seam 22.

The closure device 54 when in the closed position assists in maintaining the opening 32 of concealed pocket 10 closed and concealed along, the seam 22.

The pouch or pocket 14 in another embodiment can be removable, such that it can be easily removed and inserted into the envelope 12 by the wearer or user of the article. In this embodiment the pouch or pocket 14 is not attached to the inside on the envelope 12. The closure device 54 in this embodiment can be installed close to or at the edges of the opening 52 of the pouch or pocket 14. This will result in smaller sewing flaps 56 and 58. The elasticity of the material which makes up the seam 22 is generally sufficient to maintain the opening 32 in a closed and concealed position along the seam 22.

The concealed pocket assembly 10, in another embodiment as illustrated in FIGS. 8–13, is depicted incorporated into an otherwise conventional man's swimsuit.

Figure 8:
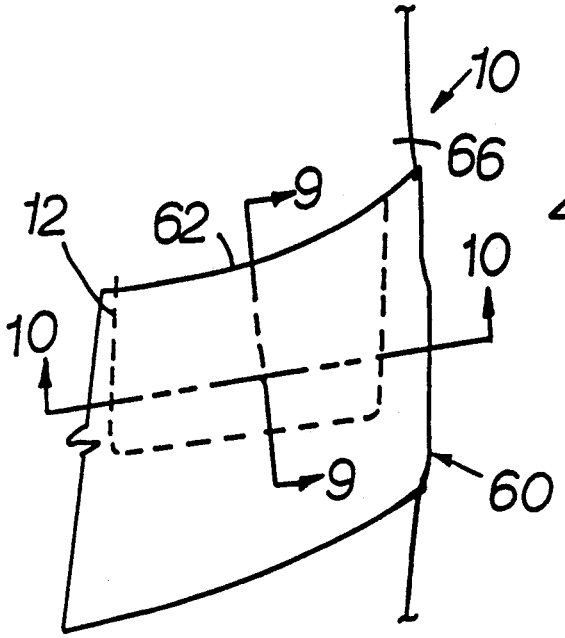
FIG. 8 depicts another embodiment of the concealed pocket of the present invention with a removable assembly constructed in accordance with the present invention.
Figure 8:
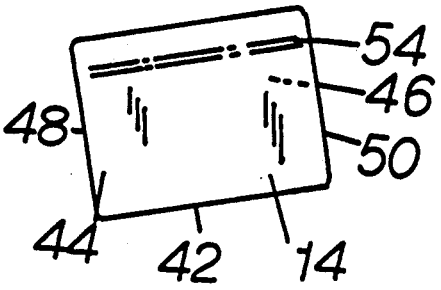
Figure 9:
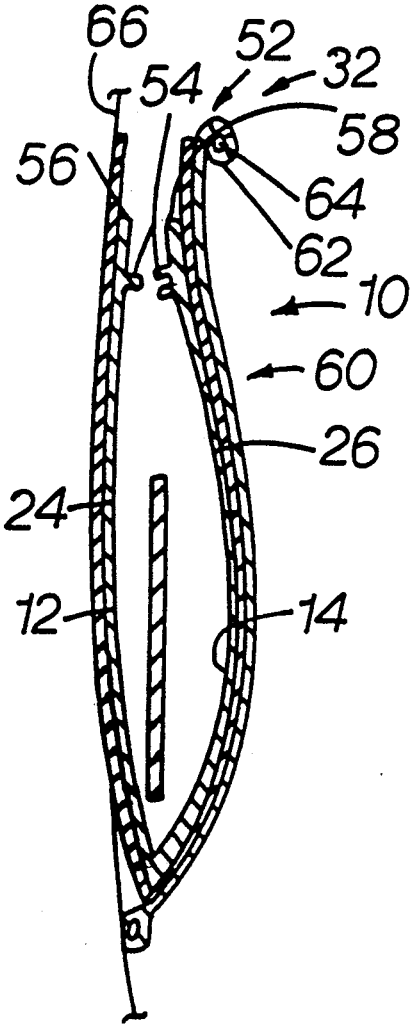
FIG. 9 is a cross-sectional view taken along line 9—9 in FIG. 8.
Figure 10:
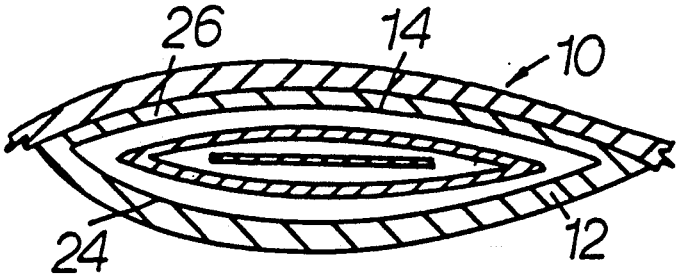
FIG. 10 is a cross-sectional view taken along line 10—10 in FIG. 8.

In the embodiment illustrated in FIGS. 8–10, the pocket 14 is removable and the envelope 12 is incorporated along the elastic edge 62 of the waist of the swimsuit. The envelope 12 is constructed from a piece of material separate from the swimsuit 60, as illustrated in this example. The material is generally sized by the desired dimensions of the envelope 12. When the material is cut, the dimensions would be determined in part by the particular construction, panel portions or members sewn together or folded and sewn along the edges.

It will be understood that, if folded, the panel length is approximately twice the desired depth of the envelope 12 and the inner and outer folded portions provide an inner panel or an outer panel. As described above, the adjacent edges of the folded material are joined or sewn to form the sides 24 and 26 of the envelope 12.

The envelope 12, in this embodiment, is attached to the swimsuit 60 by sewing one side of the envelope 12 to the inside of the swimsuit 60 along the elastic edge 62. Generally, the envelope 12 will be attached at a location on the front somewhat off center toward either the left or right side. However, it will be understood that the envelope 12 could just as easily be installed elsewhere as desired by the designer or manufacturer of the clothing article.

The envelope 12 is attached to the elastic edge 62 in such a manner that the opening 32 of the envelope 12 will be between the elastic 64 and the body 66 of the wearer. The opening 32 would be somewhat below the top edge of the elastic edge so that the opening will remain concealed. The elastic 64 holds the opening 32 in a closed position by pressing the opening 32 against the body 66 of the wearer. This in effect closes the envelope 12 and conceals the concealed pocket 10 along the natural line, or elastic edge 62 of the swimsuit 60.

The pocket 14 is constructed as described above in the embodiment illustrated in FIGS. 8–10, wherein the pocket 14 is removable and is similar in construction and use to the removable embodiment as described above.

Figure 11:
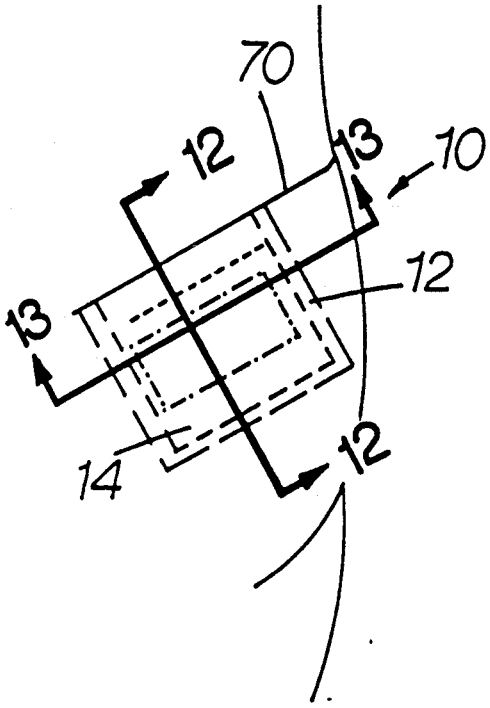
FIG. 11 depicts another embodiment of the concealed pocket of the present invention constructed in accordance with the present invention.
Figure 12:
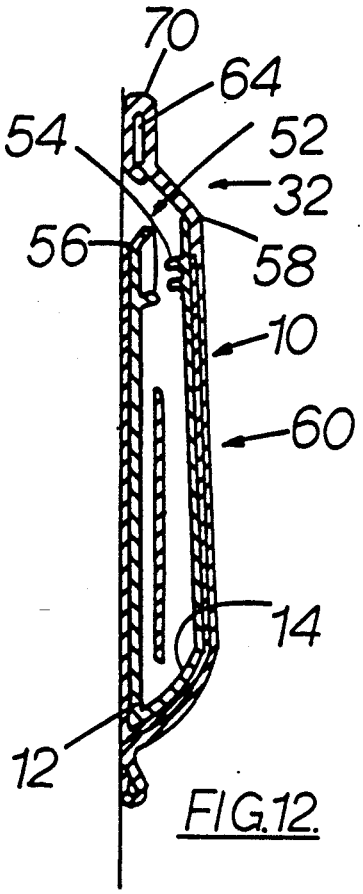
FIG. 12 is a cross-sectional view taken along line 12-12 in FIG. 11.
Figure 13:
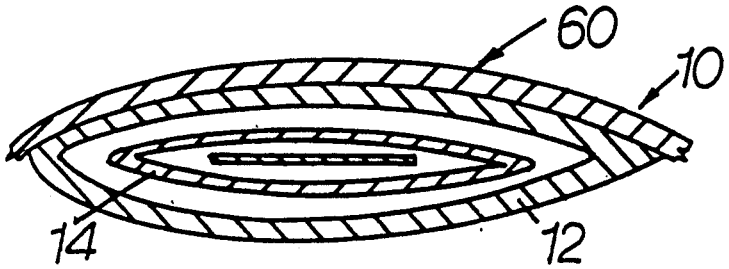
FIG. 13 is a cross-sectional view taken along line 13-13 in FIG. 11.
Figure 14:
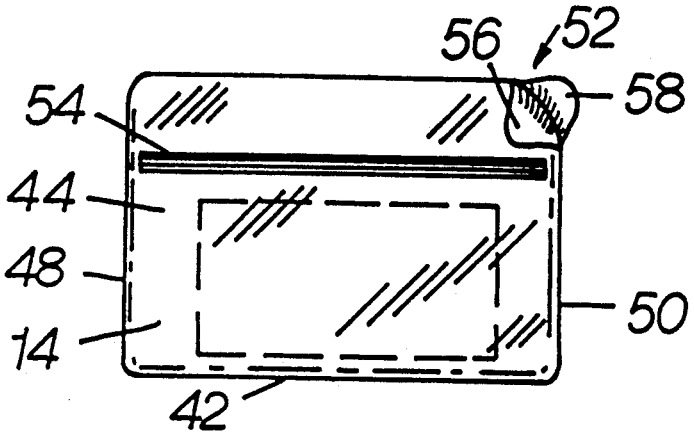
FIG. 14 is an elevation of a pocket assembly or removable pouch depicting an alternate sliding closure assembly.
Figure 15:
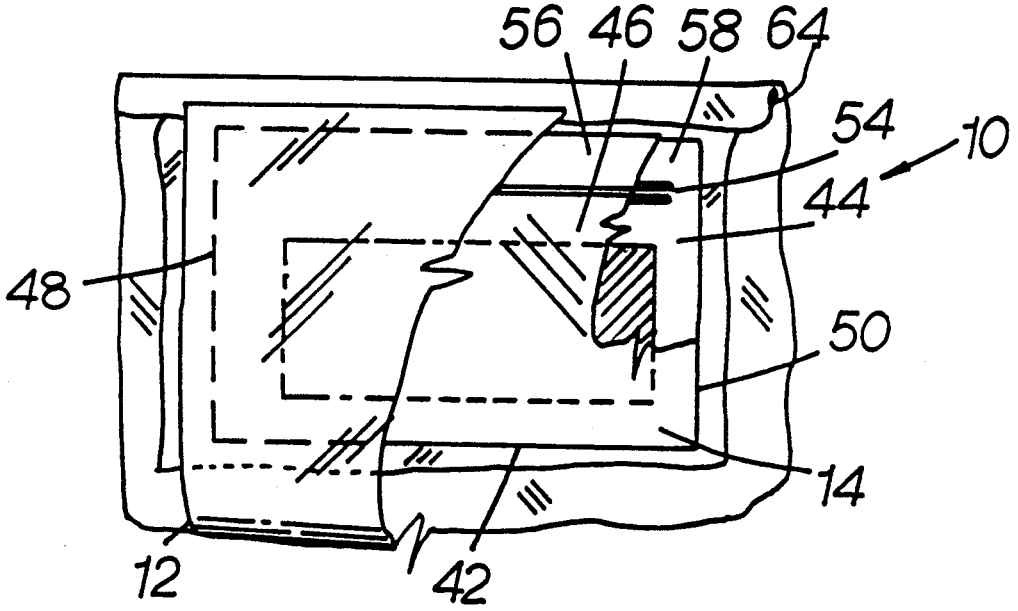
FIG. 15 is a partial inner elevation depicting the fabric and liner layers of one preferred embodiment of the present invention suitable for use in the various clothing constructions.

FIGS. 11–13 illustrate an embodiment of the concealed pocket assembly 10 having a permanently installed pocket pouch 14 in a man's swimsuit 60.

The envelope 12 is constructed in a similar manner as the envelope described in the embodiment illustrated in FIGS. 8–10 with the position of the pouch or envelope 12 modified to the suit. In this embodiment, one side of the envelope 12 is attached to the swimsuit 60 by sewing or other means, at a location slightly below the elastic edge 62.

The side of the envelope 12 is sewn to the bottom stitching of the elastic seam 70. This seam 70 is created in the manufacturing process of the swimsuit when the upper edge of the swimsuit is folded over the elastic 64 and sewn down around the elastic 70.

The pocket 14 is again as described above, and is attached to the inside of the pocket 12 by the sewing flaps 56 and 58. The sewing flaps 56 and 58 are typically attached by sewing. Generally, the top edge of the sewing flaps 56 and 58 are aligned with the top edges of the envelope opening 32 when the pocket 14 is attached. In this arrangement the envelope opening 32 and pocket opening 52 operate together as a single opening to the concealed pocket 10.

Being somewhat below the elastic edge 60 the opening to the concealed pocket 10 remains substantially concealed. The seam 70 substantially hides and covers the opening. The seam 70 and the tension of the elastic 64 urge the opening to the concealed pocket closed and generally secure. Additionally, the closure device 54, if utilized, further insures that the opening to the envelope 12 and pocket 14 tend to a closed position.

In constructing the assembly, in connection with the clothing article applications previously mentioned to provide a generally concealed pocket in an otherwise conventional clothing article, a pocket means is constructed for receiving an article. The pocket can be either removable or not, and the outer panel and the inner panel of the envelope are attached to the pocket means in an embodiment that is not removable.

The marginal members or portions are provided as with the sewing flaps previously identified. These marginal portions, either one or the other or both of the inner and outer panel sewing flaps, extend past the pocket. The assembly is attached; in particular the envelope is attached to an adjacent fabric portion with the outer panel means or member intermediate the fabric portion and the pocket means.

The assembly is constructed in order to space the attachment generally away from an edge of the fabric portion and generally coextensive with the marginal portion.

The closure is formed by an interlocking assembly proximate the open end of the pocket or envelope. As previously described, the closure may include a "press" type fit or a sliding closure, although the former may provide more concealment, particularly with tight fitting articles such as swim suits.

It will be possible to extend a portion of the lining of a swim suit to provide the inner and the outer panels of the assembly and further incorporate the assembly into the finished garment.

The fabric panels described can be part of the finished article or can be provided as panels used to manufacture the finished product.

In a preferred embodiment, the attachments are accomplished with a straight, overlock surge, or zig-zag stitch to maintain any desired elasticity of the panels, for example, when the panels are the lining of a swim suit.

From the foregoing description those skilled in the art will appreciate that all of the objects of the present invention are realized. An improved concealed pocket assembly has been shown and described for adaptation and incorporation into clothing and other articles, such as swim wear, beach wear, active wear and exercise wear.

The concealed pocket of this invention allows for items of personal property, such as keys, money and credit cards to be carried in the concealed pocket without the items becoming water soaked or being conspicuous to others. An improved concealed pocket is provided that is assembled for incorporation into an article of clothing without creating a substantially visible line in the fabric of the article of clothing, thereby concealing the pocket and its location.

With the present invention the concealed pocket is incorporated into either a complete garment or into a patch of material that is later used to construct a garment.

A removable pouch embodiment allows removal and replacement of a separated pocket insert that is preferably a substantially sealed, water repellant or waterproof article. Thus, in either the removable or permanent embodiments, the concealed pocket is substantially waterproof for holding items of personal property and further keeping the contents dry or substantially dry even when the clothing, e.g. swim suit, is wet.

While specific embodiments have been shown and described, many variations are possible. The particular shape of the concealed pocket assembly including all dimensions may be changed as desired to suit the clothing article with which it is intended to be used. The pocket material may vary although a vinyl plastic is preferred. The inner and outer panels will usually be of the lining material of the clothing article.

Other embodiments are also possible with the specific design of the pocket and pouch, and the incorporation of the concealed pocket into the article being based upon the particular application, type of article, type of materials being used and the particular location of incorporation.

Therefore, the concealed pocket assembly of the present invention is provided for a variety of applications, including proximate the waist band of a boxer style; proximate a seam of boxers or one or two piece articles; under the waist of briefs and bikinis; and at the waist of briefs and bikinis.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A concealed pocket assembly for attaching a pocket to a fabric portion, comprising:

pocket means for receiving an article, the pocket means including closing means for substantially sealing the pocket means;

outer panel means, the outer panel means attached to the pocket means;

inner panel means, the inner panel means attached to the pocket means, the inner and outer panel means forming an envelope for the pocket means;

a marginal portion provided by the inner and outer panel means, the marginal portion adjacent the closing means and providing purchase for opening the pocket means when closed; and attachment means for attaching the envelope to a fabric portion with the outer panel means intermediate the fabric portion and the pocket means, the attachment means spaced away from an edge of the fabric portion and coextensive with the marginal portion.

2. A. concealed pocket assembly as set forth in claim 1 wherein the fabric portion is part of a complete garment and the outer panel means is a lining member.

3. A concealed pocket as set forth in claim 2 wherein the inner panel means is an effective extension of the lining member.

4. A concealed pocket assembly as set forth in claim 1 wherein pocket means includes closure means.

5. A concealed pocket assembly as set forth in claim 4 wherein the closure means is an interlocking marginal assembly integral with the envelop means.

6. A concealed pocket assembly as set forth in claim 1 wherein the fabric portion is one panel member used to construct a complete garment.

7. A concealed pocket assembly as set forth in claim 1 wherein the fabric portion includes a garment seam and the pocket assembly attachment means is spaced away from the seam portion such that the pocket assembly opening is generally concealed.

8. A concealed pocket assembly as set forth in claim 1 wherein the fabric portion includes a waistband and the pocket assembly attachment means is spaced away from the waistband.

9. A concealed pocket assembly as set forth in claim 1 wherein the pocket means is removable.

10. A concealed pocket assembly as set forth in claim 1 wherein the pocket means repels water and the attachment of the inner and outer panel generally maintains the water repellant ability of the concealed pocket assembly.

11. A concealed pocket assembly including a pocket attached to a fabric portion, comprising:

a pocket member; a plurality of panel members attached to the pocket member, the panel members defining an opening for providing access into the interior of the pocket member, the panel members forming an envelope;

an attaching means for attaching the panel members to the pocket member and for attaching the panel assembly to a fabric portion, the attachment means attaching the pocket assembly to the fabric portion and substantially concealing the pocket assembly.

12. A concealed pocket assembly as set forth in claim 11 wherein the pocket assembly attaches to the fabric portion adjacent an edge of the fabric portion.

13. A concealed pocket assembly as set forth in claim 11 wherein the pocket member includes a pocket having a back panel, a front panel, the front panel and the back panel attached together along adjacent sides and bottom marginal edges, the top marginal, unattached edges forming the pocket opening.

14. A concealed pocket as set forth in claim 11 further comprising a closure device associated with the pocket opening.

15. A concealed pocket as set forth in claim 14 wherein the closure device is a generally water repellant interlocking lip arrangement.

16. A concealed pocket as set forth in claim 11 wherein the edge of the fabric portion includes a seam.

17. A concealed pocket as set forth in claim 11 wherein the edge of the fabric portion includes a waist band.

18. A concealed pocket assembly as set forth in claim 1 wherein the pocket member includes a pocket having a back panel, a front panel, the front panel and the back panel attached together along adjacent sides and bottom marginal edges, the top marginal, unattached edges forming the pocket opening.

* * * * *